US005823538A

United States Patent [19]

Goldfarb et al.

[11] Patent Number: 5,823,538

[45] Date of Patent: Oct. 20, 1998

[54] GAME WITH ACTION-DISCHARGE

[75] Inventors: Adolph E. Goldfarb, 1432 S. Eastwind Cir., Westlake Village, Calif. 91361; Martin I. Goldfarb, Santa Monica, Calif.

[73] Assignee: Adolph E. Goldfarb, Northridge, Calif.

[21] Appl. No.: 944,079

[22] Filed: Oct. 4, 1997

Related U.S. Application Data

[63] Continuation-in-part of Ser. No. 796,713, Feb. 6, 1997, Pat. No. 5,704,610.

[51] Int. Cl.[6] ..... A63B 71/00

[52] U.S. Cl. ..... 273/445; 273/440; 273/457; 273/459; 273/460

[58] Field of Search ..... 273/440, 445, 273/457, 459, 460, 138.1

[56] References Cited

U.S. PATENT DOCUMENTS 3,933,354 1/1976 Goldfarb et al. ..... 273/445

5,195,751 3/1993 Senart ..... 273/459 X 5,263,714 11/1993 Rudell et al. ..... 273/457

5,470,082 11/1995 Clayton ..... 273/445

5,678,825 10/1997 Clayton ..... 273/445

*Primary Examiner*—Raleigh W. Chiu

*Attorney, Agent, or Firm*—Ashen & Lippman

[57] ABSTRACT

In one form of game the player observes and must quickly respond to the rapidly changing conditions of one or more visually observed displays such as lights to avoid being sprayed by a liquid discharge. The games is so constructed that to effectively play the game the player must generally continuously observe the condition of the lights; to do so the player must maintain her face in position to be sprayed. Alternatively, the timing of the discharge may be tied to the player's game playing activity or may even occur on a random or apparently random basis.

21 Claims, 7 Drawing Sheets

GAME WITH ACTION-DISCHARGE

RELATED APPLICATION

This application is a Continuation-in Part of U.S. application Ser. No. 08/796,713 filed Feb. 6, 1997 in the name of the same inventors now U.S. Pat No. 5,704,610.

FIELD OF THE INVENTION

Games having a physical action component directed at the players.

BACKGROUND OF INVENTION

Children love competitive action games that involve a degree of suspense and excitement. Often in such games, at some point an action occurs such as a light going on or a siren going off or something falling down. Children also enjoy participating in and causing the action and/or trying to prevent the action. There is further play value in having to react or do something once the action takes place.

SUMMARY OF ILLUSTRATED APPARATUS EMBODYING THE PRESENT INVENTION

The drawings illustrate several forms of the invention.

In one form, the game apparatus is so constructed and arranged as to require a desired portion of the player's body such as her face to be maintained in a player location or area in order for her to effectively play the game. At times dictated by the play of the game, the liquid or other discharge is directed to that player areas and thus at the player. The illustrated game apparatus has a housing with a front face. At least one elongated channel extends from the front face into the housing. Each channel has an open entrance at the front face and a visually observable display such as a light located a substantial distance down into the channel so that the player must align her line of sight with the channel to effectively see the condition (e.g., on or off) of the light. A discharge mechanism such as a spray nozzle operated by a pump is positioned on the front face adjacent to the channel entrance so that when a spray is discharged from the nozzle, it will necessarily strike the adjacent face of the player. In the play of the game, the lights sequentially go on and then off in a rapid but random or apparently random sequence. The player must closely follow the condition of the lights and take action as by depressing a button when a light comes on and before it goes off. Otherwise, the player receives a spray in the face.

IN THE DRAWINGS

DETAILED DESCRIPTION OF THE DRAWINGS

Embodiments of FIGS. 1 through 10 FIGS. 1 through 10 illustrate another game apparatus 400 which embodies a presently preferred embodiment of the invention. This game apparatus 400 is so designed and configured that the user must generally continuously position her face at a particular player area or location to be able to effectively participate in the play of the game as by observing visually observable display or indicator means. This player location also positions the user's face adjacent to the discharge means so that a discharge will strike the user in her face. This ensures that a player participating in the play of the game cannot avoid the discharge when it occurs.

Figure 1:
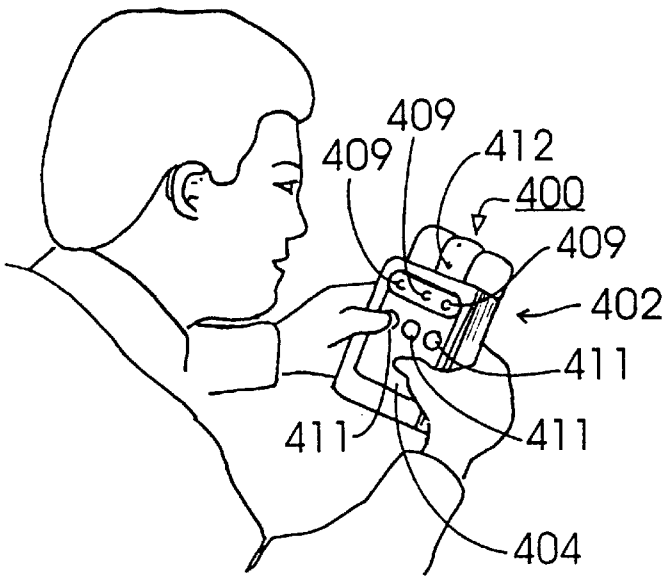
FIG. 1 is a schematic perspective view of a player holding a hand-held alternative embodiment of the game apparatus.
Figure 2:
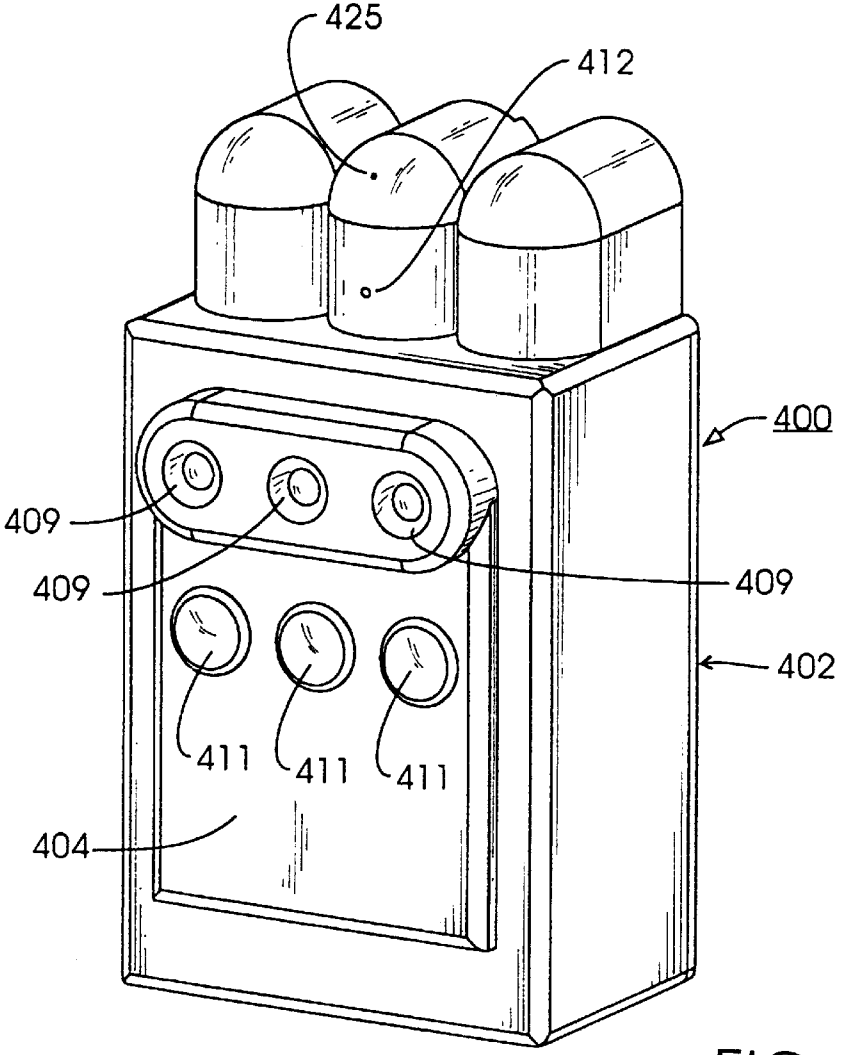
FIG. 2 is an enlarged front perspective view of the exterior of the game apparatus of FIG. 12.

FIG. 1 illustrates the game apparatus 400 being held by a player. Game apparatus 400 is in the form of a hand-held unit having a case or housing 402 having a front face 404. The housing 402 has is at least one elongated channel 408 that has an open outer end or entrance 409 at the front face 404 and extends a substantial distance into the housing. In each channel 408 a visually observable indicator or display 410 is positioned a substantial distance from the channel entrance 409. This construction requires that the player position her face with her eyes generally directly in line with the channel 408 to be able to effectively see and determine the condition, such as on or off, of the display 410. In the preferred embodiment 400 there are a plurality of channels 408.

A liquid discharge nozzle 412 is located on the housing front face 404 adjacent to the channel 408, so as to direct its discharge flow at the face of the player looking into the channel. The player may be given only a limited amount of time to respond to the condition of the display as by operating an associated response means such as a depressable button 411 also on the housing front face. Failure to correctly respond in time causes a discharge from the nozzle against the player's face.

In the play of the illustrated game apparatus 400, the visual displays 410 sequentially and rapidly turn on and off in a random or apparently random order. When each display 410 goes on, the player attempts to quickly depress the associated button 411 before the display goes off Whenever a button 411 is not depressed quickly enough or the wrong button is depressed, the player receives a spray in the face from the nozzle 412.

More particularly, as shown in FIGS. 2 through 5, the hand-held game apparatus 400 includes the generally rectangular casing or housing 402. Mounted on the front face 404 of the housing, in a line extending side by side at about the center of the face, are three response buttons 411. Also on the front face 404 and in a line side by side, each aligned with one of the buttons 411, are openings or entrances 409 to three channels 408. The channels 408 each extend a substantial distance into the housing. Each response button 411 is associated with the aligned channel 408. A visually observable display 410 in the form of a small light emitting element such as an LED is located within each of the three channels 408, a substantial distance from the associated channel entrance 409. LEDS are cheap and practical, and thus generally preferred, but other light emitting elements such as incandescent bulbs might be utilized. Using relatively narrow channels and positioning the LED a substantial distance from the channel entrances requires that the eyes of the player be kept generally aligned with the channels. Otherwise the player cannot effectively observe the changing condition of the LEDS within the channels. In practice, cylindrical channels each having a diameter of about one quarter of an inch and a length from entrance to LED of about one and one-half inches operates effectively to require the face of the player to be positioned closely adjacent to the channel entrances.

The liquid discharge nozzle 412 is located adjacent to and centrally above the channel entrances 409 so that when the player aligns the channels 408 with her line of sight as shown in FIG. 1, the liquid discharge or spray from the nozzle 412 will be directed against the player's face such as her forehead. The position of the nozzle 412 ensures that it will not be covered over or obstructed by the player's hand that hold the unit.

As noted above, the LED 410 may go on and off rapidly in a different random or apparently random order for each player turn or round. Thus an individual LED 410 may turn on for a limited predetermined time period and then go off as another of the LED turns on for its limited predetermined time period, and so on. If the player does not successfully depress the associated button 411 (or depress a wrong button) before the LED 410 goes off, she will be sprayed from the nozzle 412.

Figure 3:
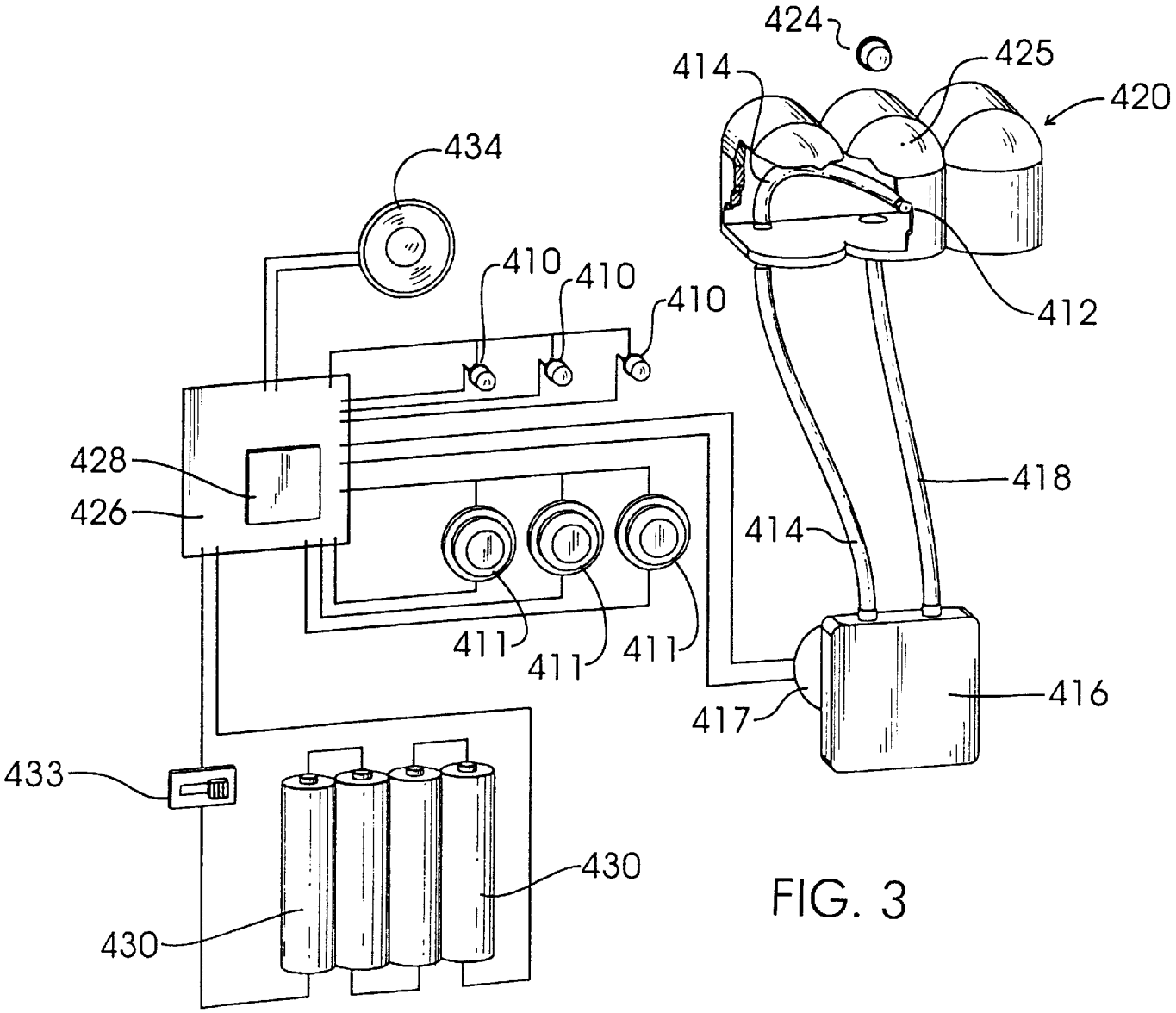
FIG. 3 is a schematic and diagrammatic showing of components of the game apparatus of FIG. 1, and of the connections between the components.

It is important that the game be constructed and played so as to ensure the generally continuous need for the player to maintain observation of the visual display, which in turn maintains the player in position to be sprayed. In this connection and for this purpose, the randomness of the sequence of displays has been noted. If there were only a single display-and-button combination, the need for generally continuous observation could be ensured by varying the intervals between the displays being on and/or requiring that the response begin within a limited time after a display goes on and that it continue until the display goes off FIG. 3 illustrates in a schematic and diagrammatic way the various components of the hand-held game apparatus 400, and the connections between the components.

The illustrated nozzle 412 is connected through a first conduit 414 to a standard liquid pump 416 mounted in the housing 402. The pump 416 may be operated by a standard electric motor 417 which may be powered by a set of replaceable batteries 430. The pump 416 is in turn connected through a second conduit 418 to a liquid-holding tank or section 420 formed by the upper portion of the housing 402. The tank 420 is thus located above the pump 416. The tank 420 has a filling opening with a removable plug 424. The plug 424 can be accessed and removed from the outside of the housing 402 so that the tank 420 can be periodically filled and refilled by the player as needed. The tank 420 has an air vent 425.

The game apparatus 400 includes a circuit board 426 on which a preprogramed computer chip 428 is mounted. The chip 428 controls the operation of the game. The chip 428 may be powered by the set of batteries 430. The illustrated batteries 430 are mounted in a suitable compartment within the housing 402 and are accessible by removing a cover 431. The chip 428 may be electrically connected by suitable standard connections to the LEDS 410, to the depressable buttons 411, and to a speaker 434. Further, the chip may be electrically connected to the pump motor 417.

When the game is turned on, as by an on/off switch 433, a player turn begins. The chip 428 sends signals to the LEDS 410 to cause them to sequentially turn on and off in random or apparently random order, each for a predetermined time period. Whenever one of the lit LEDS 410 goes off before the associated button 411 has been depressed by the player (or the wrong button is depressed), the chip 428 turns on the motor 417. This operates the pump 416 to discharge liquid from the nozzle 412. As emphasized above, since the player must align her eyes with the channels 408 to effectively observed the condition (on or off) of the LEDS 410, the face of the player will necessarily be positioned in front of the nozzle 412 to so as to receive a spray from the nozzle when the player fails to depress the right button 411 in time or depresses the wrong button. In the illustrated apparatus 400, the chip 428 automatically shuts off the spray after a brief period. This arrangement is preferred to a manual stop or off switch as it avoids spraying excess liquid into the surrounding environment.

Alternatively, instead of responding to a single lit LED, the game may be arranged so that the player responds to a series or sequence of lit LEDS, attempting to press buttons corresponding to the sequence.

A player turn may end after a predetermined time period or number of lit LEDS. A new player turn may then be commenced.

Figure 4:
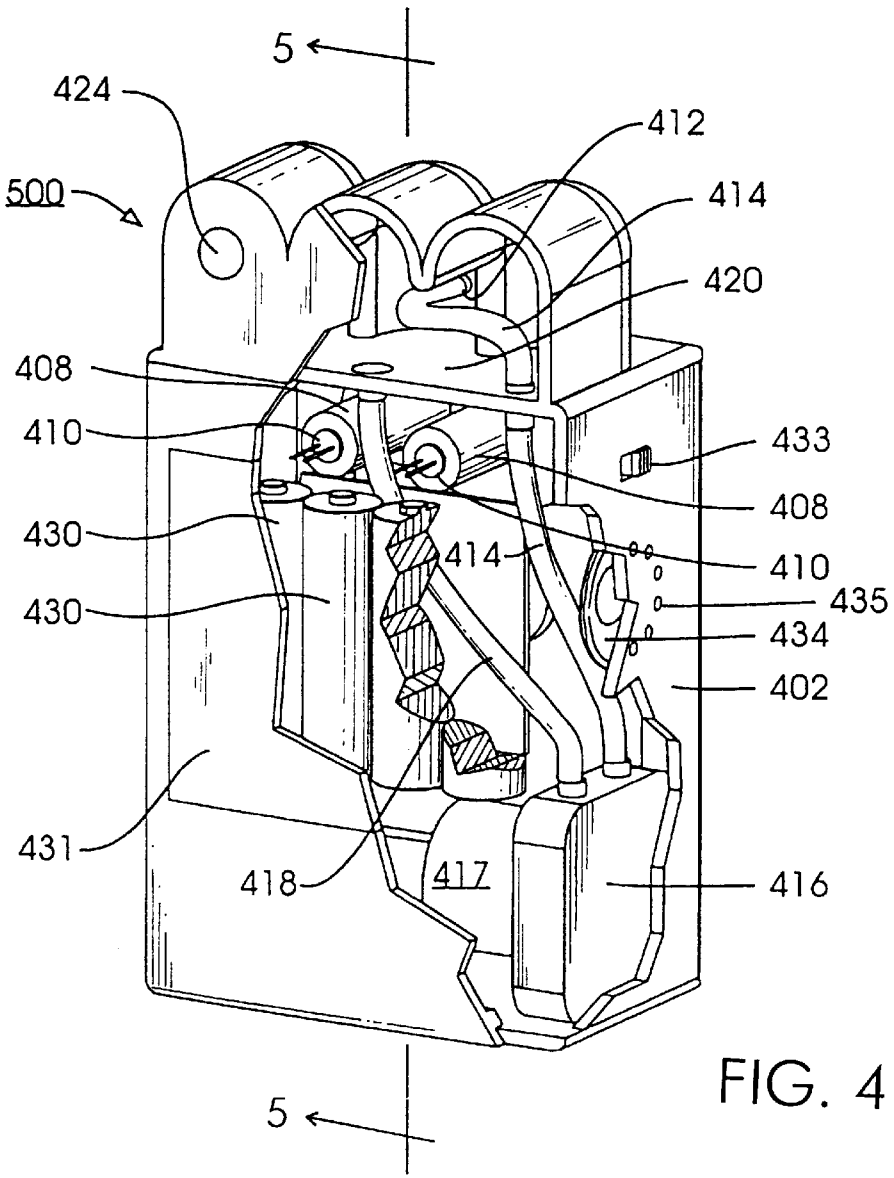
FIG. 4 is a rear perspective view of the game apparatus of FIG. 1 with portions broken away to reveal details of construction.

FIG. 4 shows the placement of the components in the illustrated housing 402.

The pump 416 is in the lower end of the housing 402. The first conduit 418 extends down to the pump 416 from the tank 420 that is formed in the upper portion of the housing 402. The second conduit 414 extends from the pump 416 up to the nozzle 412, which is at the upper end of the housing at the housing front face 404. Three cylinders that each provide one of the channels 408 are supported with their entrances 409 at the housing front face 404. The entrances 409 are located a short distance below the nozzle 412. At the rear end of each channel 408 one of the LEDS 410 is supported. (See FIGS. 4 and 5). The batteries 430 are supported in the compartment that extends across the rear of the housing. The compartment has the openable cover 431. The on/off switch 433 is at the side of the housing 402, as is a set of speaker openings 435 to facilitate emission of sound from the speaker 434.

Figure 10:
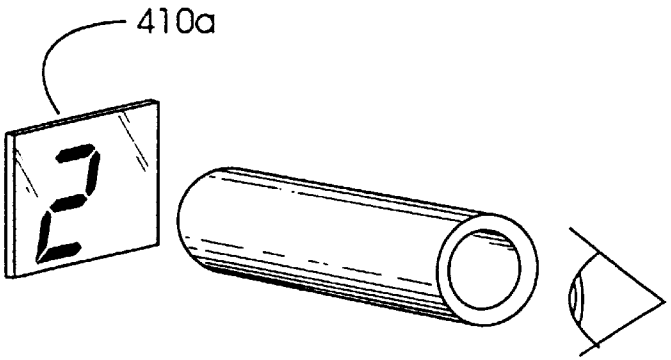
FIG. 10 is an enlarged schematic exploded view of an alternative visual display in the form of an LCD screen.
Figure 6:
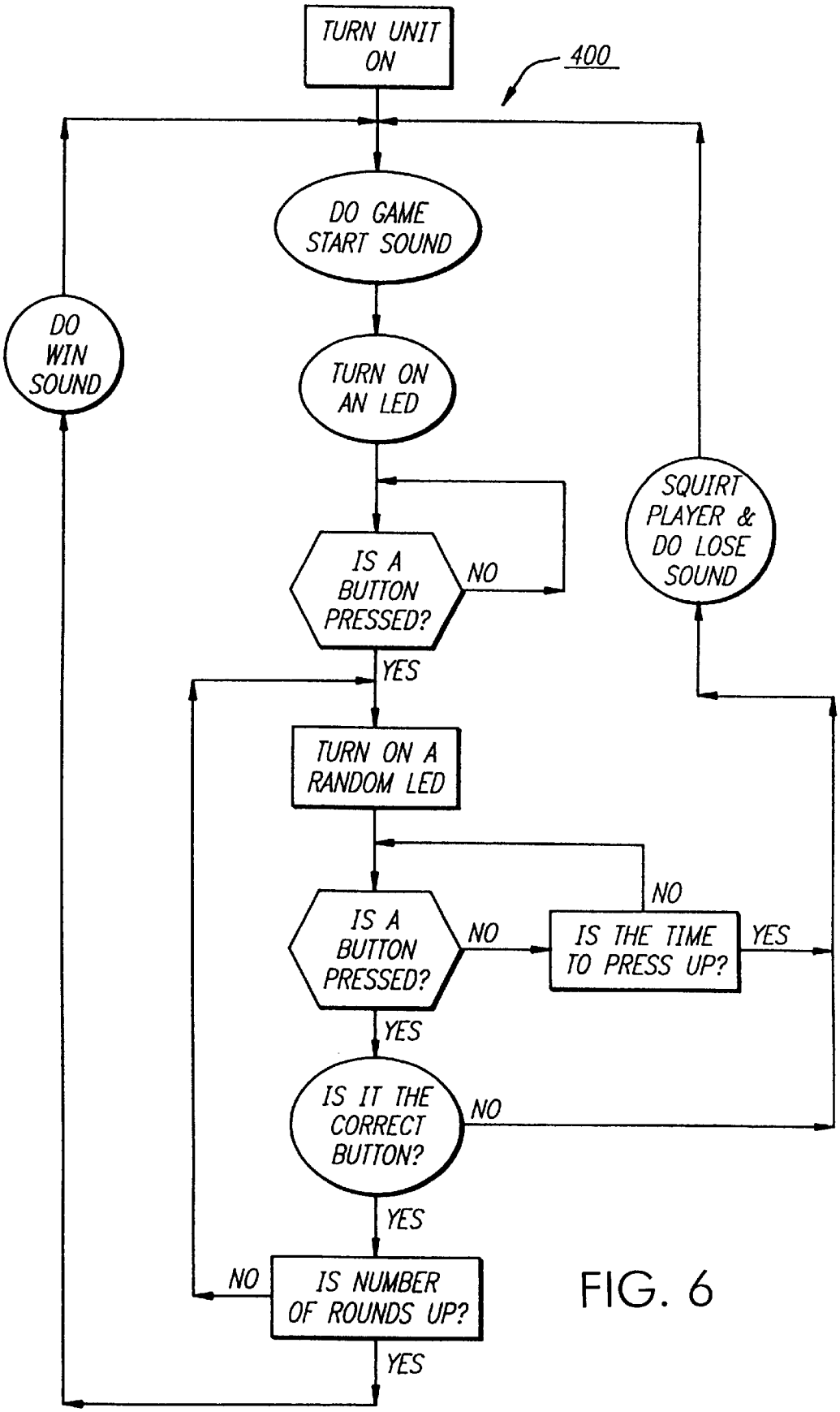
FIG. 6 is a flow chart showing the operation of the game apparatus of FIG. 1.

FIG. 6 is a flow chart showing in detail the steps in the operation of game 400. FIG. 10 illustrates an alternative visually observable display 410*a* in the form of an LCD screen capable of displaying various different images such as the numerals 1, 2 and 3. Using this display 410*a*, the player could be required to press buttons designated 1,2, or 3 in response to the numeral observed on the display.

Figure 7:
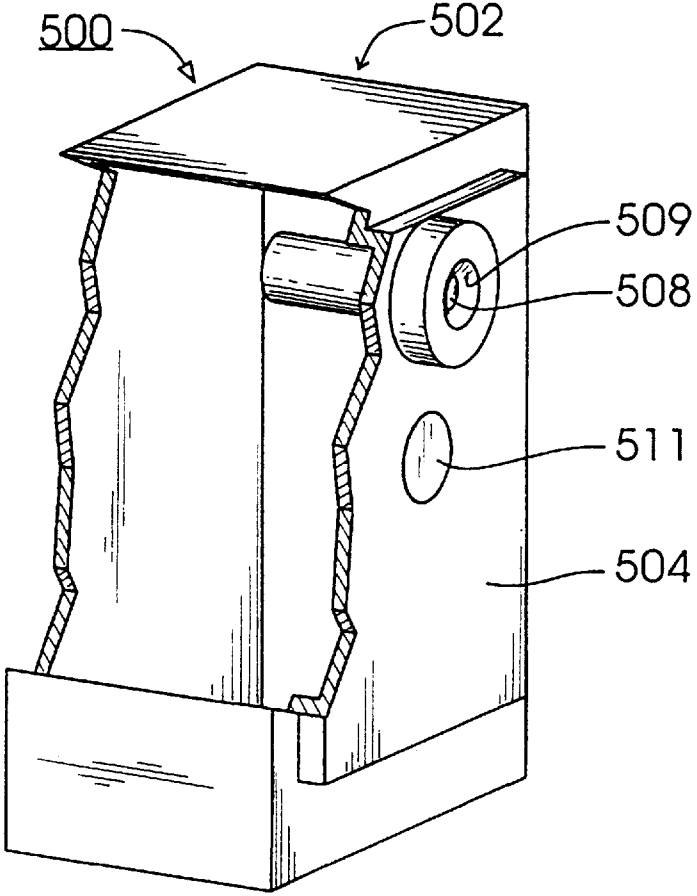
FIG. 7 is a schematic front perspective view of portions of an alternative embodiment of game apparatus.
Figure 5:
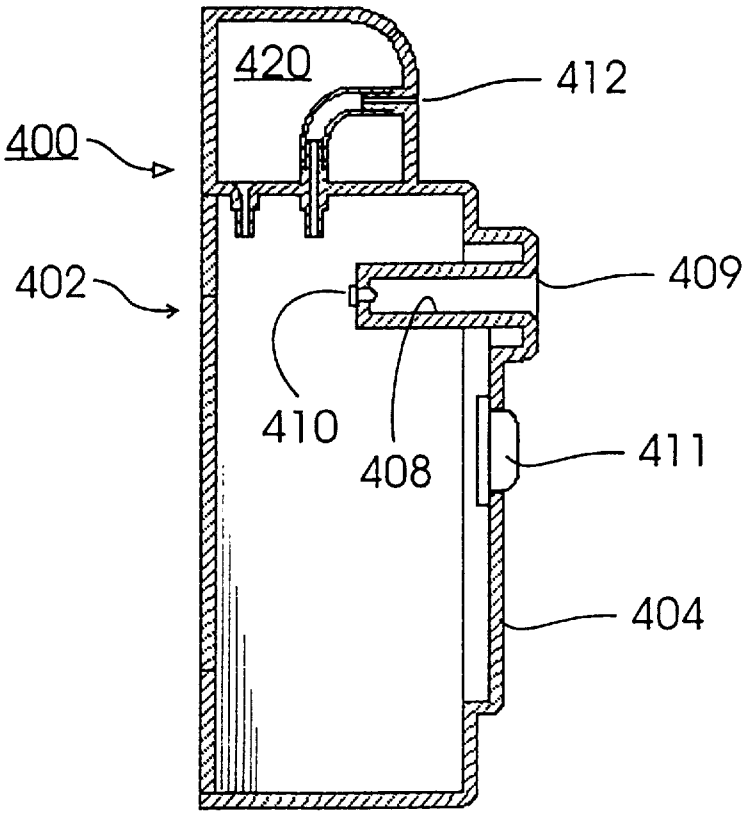
FIG. 5 is a further enlarged side sectional view taken generally along line 5—5 of FIG. 4.

FIG. 7 schematically illustrates portions of an alternative embodiment of game apparatus 500 which operates on a random or apparently random basis, but utilizes game action undertaken by the player or players to determine when the spray nozzle 512 will be actuated. Such game apparatus 500 is similar to game apparatus 400 but it has only a single channel, LED and button combination. Further, the time of actuation of the spray nozzle 512 is made additionally dependent upon a predetermined physical game action such as the total number of times the player has depressed the response button 511. Thus, for each player turn, the chip 528 would establish, on a random or apparently random basis, a different total number of depressions that would actuate the spray. The player would be sprayed and lose points for failing to correctly respond as by pushing the correct button in time, and would also be sprayed when the predetermined total number of button depressions was reached. The player is not told the predetermined number of button depressions, and so she would have to guess when to stop with her accumulate points rather than continue and take the risk of being spray and losing points.

Figure 8:
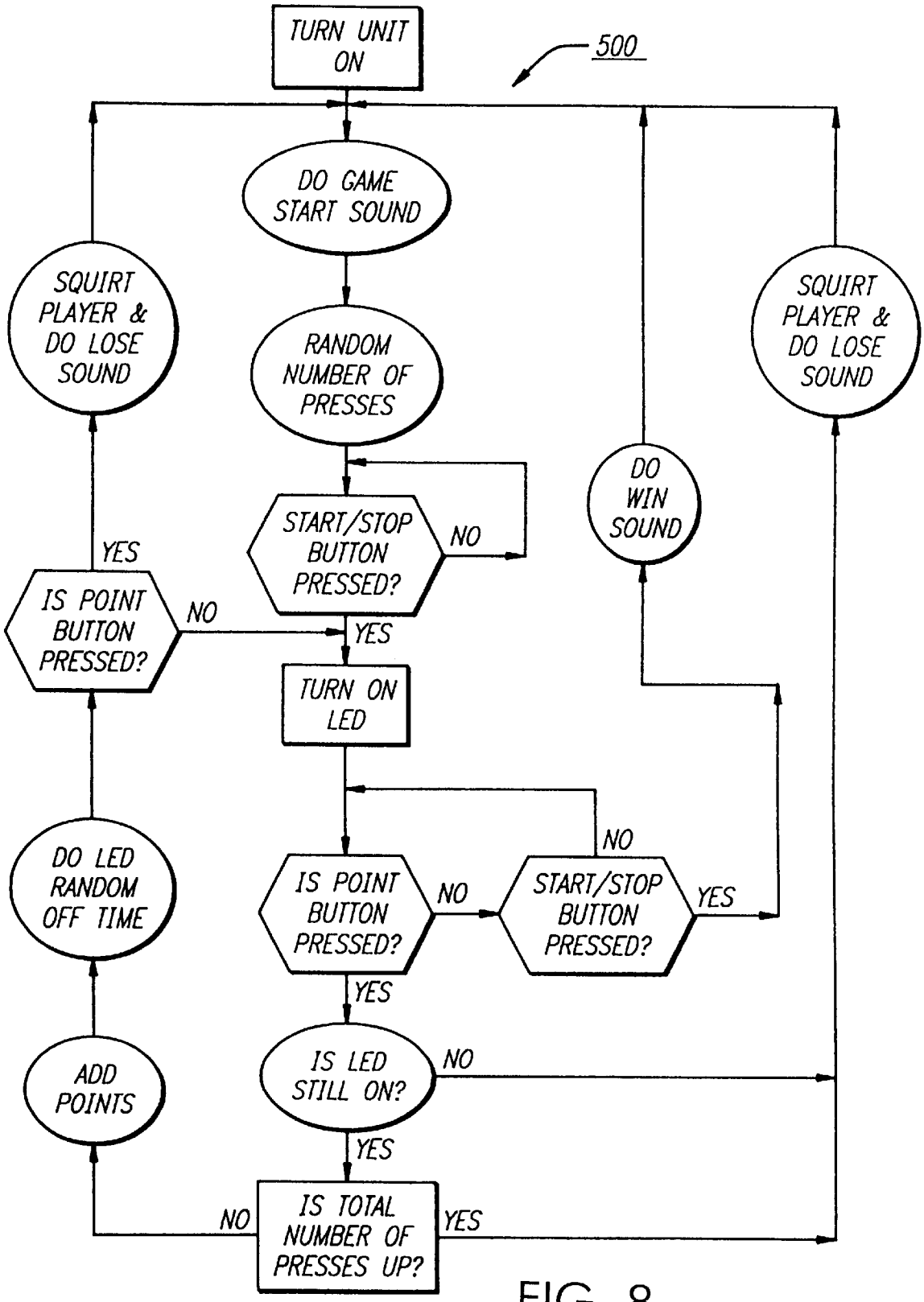
FIG. 8 is a flow chart showing the operation of the game apparatus of FIG. 7.

As noted above, the game apparatus 500 as shown in FIGS. 5 and 7 has only the single channel 508 with the single associated response button 511. To ensure generally continuous observation by the player, the intervals between displays 510 being on may be varied (randomly or apparently randomly). Thus, the player could not effectively anticipate and simply press the button 511 at regular intervals. Along the same lines, the duration of time that displays are on could also be varied and the player required to keep the button pressed until immediately after a display goes off FIG. 8 is a flow chart showing in detail the steps in the operation of the game apparatus 500.

Figure 9:
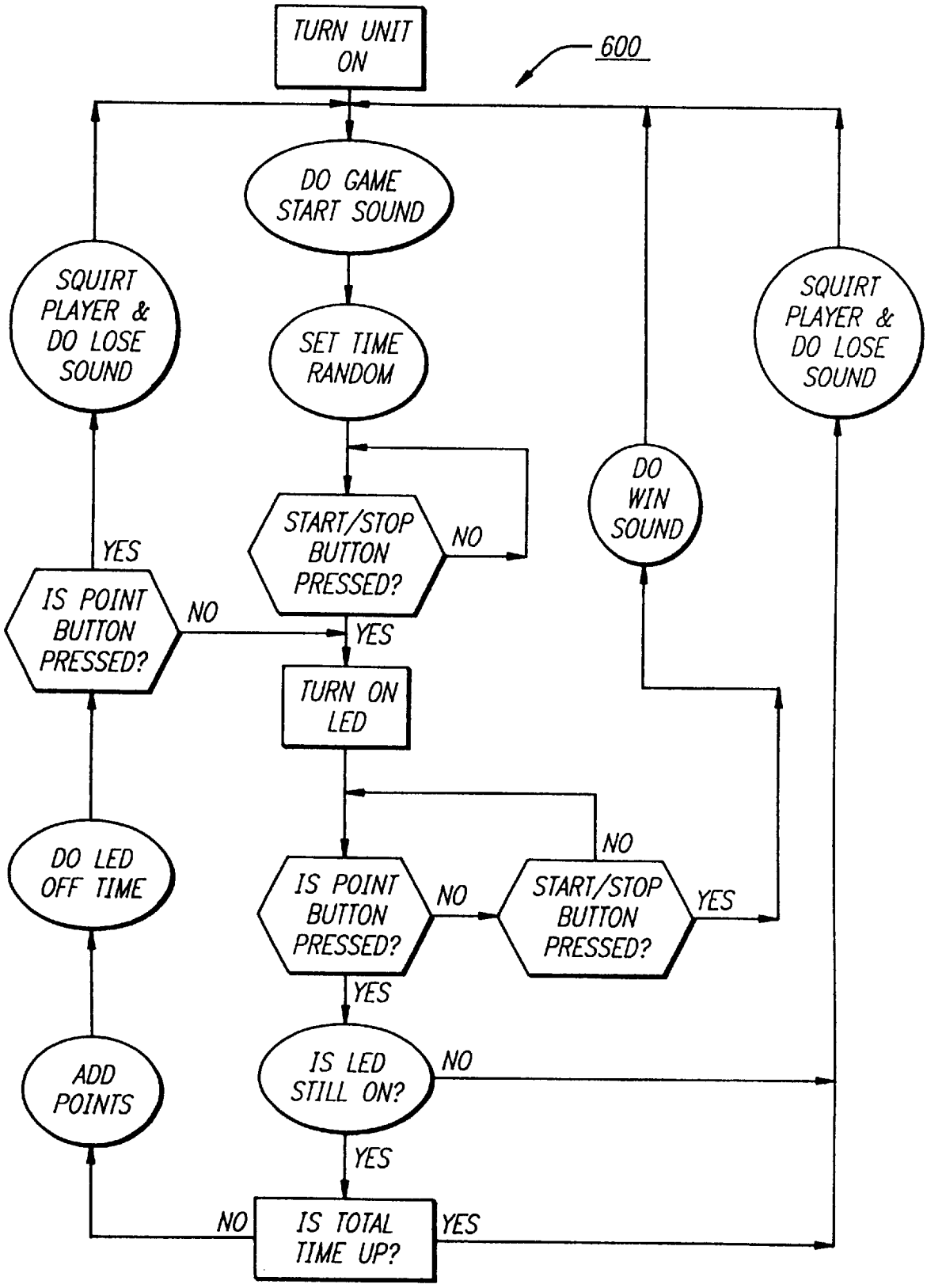
FIG. 9 is a flow chart showing the operation of the game apparatus of a further modified game apparatus.

The game apparatus 500 may be further modified as shown by the flow chart of FIG. 9.

In this further modified game apparatus 600, for each player turn, a total time is established by the chip on a random or apparently random basis. This total time is unknown to the player. The play of the game continues as with game apparatus 500. The player can stop whenever she chooses. The longer the play continues, the more points the player can accumulate, but the greater the risk that the total time set for that turn will expire and she will be sprayed and lose her points.

As used in this patent application, the terms "operation" and "movement" as applied to a game response element or part includes non-operation or non-movement as well. For example, a player's failure to push a response button before the associated display goes out would be the requisite "operation" or "movement" that causes or provides a discharge.

Various modifications and changes may be made in the illustrated without departing from the spirit and scope of the present invention as set forth in the following claims.

What is claimed is:

1. A game apparatus comprising:

At least one visually observable display that can be viewed by a player only when the head of the player is positioned in a predetermined player area, the display being changeable between at least two different visual conditions, at least one game response means operable by the player in response to the condition of the display as viewed by the player, and in accordance with a predetermined game requirement, and at least one game discharge means operatively associated with the response means to provide a discharge toward the player area dependent upon the operation of the response means.

2. The game apparatus of claim 1 wherein said discharge is in the form of a liquid flow.

3. The game apparatus of claim 2 wherein said liquid flow is in form of a defused spray.

4. The game apparatus of claim 2 wherein said game discharge means comprises a refillable liquid holding tank, a liquid pump and a discharge nozzle.

5. The game apparatus of claim 4 further including stop means for automatically stopping the discharge of the liquid flow after a relatively short time.

6. The game apparatus of claim 1 wherein said visually observable display is physically blocked from the player's view except along a specific limited path.

7. The game apparatus of claim 6 wherein said visually observable display is located within an elongated channel that has an open outer end, the display being positioned substantial distance from said outer end.

8. The game apparatus of claim 1 wherein said visually observable display comprises at least one light emitting element that is changeable between at least two conditions of relatively different brightnesses.

9. The game apparatus of claim 1 wherein said visually observable display comprises at least one light emitting element that is changeable between an on condition and an off condition.

10. The game apparatus of claim 1 wherein said visually observable display is a light emitting element that is changeable between conditions where the element emits at least two different colors.

11. The game apparatus of claim 1 wherein said visually observable display is changeable between conditions wherein it displays at least two different visual images.

12. The game apparatus of claim 1 wherein there are a plurality of said visually observable displays.

13. The game apparatus of claim 11 wherein there is at least one game response means associated with each of said multiple visually observable displays.

14. The game apparatus of claim 1 wherein said apparatus is in the form of a hand-holdable unit having a housing, and said visually observable display, game response means and said discharge means are all mounted on said housing.

15. The game apparatus of claim 1 wherein said game response means is in the form of an element that undergoes movements, and said game discharge means provides a discharge which is determined, for each player turn, by a random or apparently random number of said element movements.

16. A game apparatus comprising:

at least one visual game indicator that can be viewed by a player only when the head of the player is positioned in a predetermined player area, the indicator changing between at least two different visual conditions, the player's play of the game being dependent upon the player generally continuously viewing the condition of the indicator, and at least one game discharge means operable to provide a discharge toward the player area at random or apparently random time.

17. A game apparatus comprising:

a) at least one liquid discharge mechanism for directing a liquid discharge toward a player area where a player of the game is positioned during play of the game associated with said game apparatus, and b) game means operatively connected to the liquid discharge mechanism for causing the mechanism to discharge liquid toward said player area, said game means being selectively operable by a player of the game in at least two different modes, said liquid discharge mechanism being caused to discharge by the operation of the game means in at least one of its modes but not in all of its modes.

18. A game apparatus comprising:

a) at least one liquid-discharging mechanism for directing a liquid discharge toward a player area where a player of the game is positioned during the play of the game associated with said game apparatus, and b) game means operatively connected to the liquid discharging mechanism for causing the mechanism to discharge liquid toward said player area, said game means including a movable element, movement of said element causing said game means to operate said mechanism, such movement of said element being dependent upon the play of said game.

19. A method for playing a game, said method comprising the steps of providing at least one visual game indicator that can be viewed by a player only when the head of the player is positioned in a predetermined player area, the indicator changing between at least two different visual conditions, providing at least one game response means operable by the player in response to the condition of the indicator as viewed by the player, and in accordance with a predetermined game requirement, providing at least one game discharge means operatively associated with the response means to provide a liquid discharge toward the player area dependent upon the operation of the response means, having a player view the visual game indicator with her head in the predetermined player area.

having the player operate the response means in response to the condition of the indicator as viewed by the player, and in accordance with the predetermined game requirement, and having the discharge means provide a discharge toward the player area in response to the operation of the response means.

20. The method of claim 19 wherein the indicator changes rapidly between conditions.

21. The method of claim 20 wherein to prevent a liquid discharge, the player must operate the response means before the indicator changes to a new condition.

* * * * *